US010302383B2

(12) United States Patent
Maga

(10) Patent No.: US 10,302,383 B2
(45) Date of Patent: May 28, 2019

(54) SIDE-LOADING FIXED MAGAZINE WITH RETRACTABLE FOLLOWER AND HINGED AMMUNITION LOADING DOOR

(71) Applicant: David Dallas Maga, Castaic, CA (US)

(72) Inventor: David Dallas Maga, Castaic, CA (US)

( * ) Notice: Subject to any disclaimer, the term of this patent is extended or adjusted under 35 U.S.C. 154(b) by 0 days.

(21) Appl. No.: 15/950,142

(22) Filed: Apr. 10, 2018

(65) Prior Publication Data

US 2018/0292155 A1 Oct. 11, 2018

Related U.S. Application Data

(60) Provisional application No. 62/483,827, filed on Apr. 10, 2017.

(51) Int. Cl.

| | |
|---|---|
| ***F41A 9/65*** | (2006.01) |
| ***F41A 17/38*** | (2006.01) |
| ***F41A 9/67*** | (2006.01) |
| ***F41A 3/66*** | (2006.01) |
| ***F41A 9/70*** | (2006.01) |

(52) U.S. Cl.
CPC ..... *F41A 17/38* (2013.01); *F41A 3/66* (2013.01); *F41A 9/67* (2013.01); *F41A 9/70* (2013.01)

(58) Field of Classification Search
CPC ..... F41A 9/65; F41A 9/67; F41A 9/83; F41A 9/71; F41A 17/38
USPC ..... 42/50, 49.01, 18, 87
See application file for complete search history.

(56) References Cited

U.S. PATENT DOCUMENTS

| | | | | |
|---|---|---|---|---|
| 1,797,951 A * | 3/1931 | Gaidos | ..... | F41A 9/67 42/50 |
| 2,477,936 A * | 8/1949 | Molins | ..... | F41A 9/76 89/33.01 |
| 2,585,738 A * | 2/1952 | Chapin | ..... | F41A 9/55 42/18 |

(Continued)

FOREIGN PATENT DOCUMENTS

WO 2009032742 A1 3/2009

OTHER PUBLICATIONS

Website Link: https://www.armaglock.com/ Downloaded Jan. 12, 2017 AR-15 Fixed Magazine.

(Continued)

*Primary Examiner* — Michael D David
(74) *Attorney, Agent, or Firm* — Russ Weinzimmer & Associates, P.C.

(57) ABSTRACT

An affixable magazine in compliance with new firearms laws that enables citizens to legally own and effectively operate a firearm, such as an AR-15. The affixable magazine allows a user to easily load ammunition through a hinged door without removing the magazine from the firearm, disassembling the action, or using tools. The affixable magazine includes: a magazine body configured to contain a stack of cartridges, and an attachable blocking tab for blocking removal of the ammunition magazine from the magazine well, the attachable blocking tab being attached after insertion of the ammunition magazine into the magazine well, and before re-engaging the upper receiver with the lower receiver. The affixable magazine also includes a magazine body having an opening, with a hinged door configured to alternately cover or reveal the opening, the magazine body including: at least one finger-pull slot with a bottom hook for locking the follower.

18 Claims, 6 Drawing Sheets

(56) References Cited

U.S. PATENT DOCUMENTS

| | | | | | |
|---|---|---|---|---|---|
| 2,908,987 | A * | 10/1959 | Allyn | F41A 9/65 | 124/52 |
| 3,005,279 | A * | 10/1961 | Brewer | F41A 3/22 | 42/18 |
| 4,430,821 | A | 2/1984 | Vincent | | |
| 4,502,237 | A * | 3/1985 | Krogh | F41A 9/70 | 42/50 |
| 4,588,240 | A | 5/1986 | Ruehl et al. | | |
| 4,614,052 | A | 9/1986 | Brown et al. | | |
| 4,688,344 | A | 8/1987 | Kim | | |
| 4,707,941 | A * | 11/1987 | Eastman | F41A 9/68 | 42/49.02 |
| 5,278,690 | A | 1/1994 | Vella-Coleiro | | |
| 5,461,811 | A | 10/1995 | Ciener | | |
| 5,697,179 | A * | 12/1997 | Vanmoor | F41A 9/65 | 42/50 |
| 5,806,224 | A | 9/1998 | Hager | | |
| 6,212,815 | B1 * | 4/2001 | Fitzpatrick | F41A 9/65 | 224/196 |
| 6,311,603 | B1 | 11/2001 | Dunlap | | |
| 6,481,136 | B1 | 11/2002 | Fitzpartick | | |
| 6,739,082 | B2 | 5/2004 | Christensen | | |
| 6,807,764 | B1 * | 10/2004 | Phillips | F41A 9/83 | 42/87 |
| 7,162,824 | B1 | 1/2007 | McCormick | | |
| 7,200,964 | B2 * | 4/2007 | Gates | F41A 9/67 | 42/49.01 |
| 7,444,775 | B1 | 11/2008 | Schuetz | | |
| 7,497,044 | B2 | 3/2009 | Cammenga et al. | | |
| 7,941,955 | B2 | 5/2011 | Stone | | |
| 8,316,567 | B2 * | 11/2012 | Douglas | F41A 9/67 | 42/50 |
| 8,418,390 | B1 | 4/2013 | Wright | | |
| 8,720,095 | B2 * | 5/2014 | Wright | F41A 9/65 | 42/50 |
| 8,756,845 | B2 | 6/2014 | Harris et al. | | |
| 9,103,614 | B2 * | 8/2015 | Froehle | F41A 9/67 | |
| 9,121,652 | B1 | 9/2015 | Mangiameli | | |
| 9,303,934 | B1 * | 4/2016 | Kazsuk | F41A 9/83 | |
| 9,341,421 | B2 | 5/2016 | Findlay | | |
| 9,395,130 | B2 | 7/2016 | Jacobson | | |
| 9,482,478 | B2 | 11/2016 | Newman | | |
| 9,683,797 | B2 * | 6/2017 | Boyarkin | F41A 9/67 | |
| 2011/0173858 | A1 * | 7/2011 | Troy | F41A 9/65 | 42/50 |
| 2014/0223790 | A1 | 8/2014 | Wilson | | |
| 2015/0096214 | A1 * | 4/2015 | Jones, III | F41A 9/71 | 42/49.01 |
| 2015/0276339 | A1 * | 10/2015 | Shreve | F41A 11/00 | 42/50 |

OTHER PUBLICATIONS

Website Link: http://www.gunauction.com/buy/10420062 Downloaded Jan. 12, 2017 Semi-Auto Rifle Fixed Magazine.

Website Link: https://www.youtube.com/watch?v=F0nnd0Parco Downloaded Jan. 12, 2017 ARMagLock Install by installing an ARMagLock you no longer own a “detachable” magazine firearm. ARMagLock renders your MIL-SPEC AR-15 (and AR-10) a fixed magazine firearm while installed.

* cited by examiner

SIDE-LOADING FIXED MAGAZINE WITH RETRACTABLE FOLLOWER AND HINGED AMMUNITION LOADING DOOR

CROSS-REFERENCE TO RELATED APPLICATIONS

This application claims priority to Provisional Application No. 62/483,827, filed Apr. 10, 2017, entitled "Fixed Firearms Magazine Loadable Via a Hinged Door", the entire contents of which is herein incorporated by reference.

FIELD OF INVENTION

This invention relates generally to magazines for use with firearms, and more particularly to magazines that are affixable to a firearm such that the magazine is not removable from the firearm.

BACKGROUND OF THE INVENTION

Firearm laws have been passed in states such as California and New York which require that certain rifles and pistols must be modified to remain legal. In particular, semi-automatic firearms, such as AR-15 rifles and pistols, are being subject to more restrictions, including a prohibition against "detachable magazines". California law, for example, requires a "fixed magazine", where "fixed magazine" means an ammunition feeding device contained in, or permanently attached to, a firearm in such a manner that the device cannot be removed without disassembly of the firearm action.

Standard semi-automatic firearms have typically been made and sold for use with detachable magazines. In response to the restrictions of the newer firearms laws, semiautomatic firearms are being made and sold with fixed magazines. Further, conversion kits are being sold to convert a firearm with a detachable magazine to a firearm with a fixed magazine.

For example, Hager U.S. Pat. No. 5,806,224 teaches a semi-automatic firearm with a non-removable magazine. Also, Stone U.S. Pat. No. 7,941,955 B2 teaches a pivoting, non-detachable magazine. Further, Harris et al. U.S. Pat. No. 8,756,845 B2 teaches method and device for converting a firearm with detachable magazine to a firearm with a fixed magazine.

SUMMARY OF THE INVENTION

By providing an affixable magazine according to the new firearms laws of many states, citizens of those states will be able to legally own a firearm, such as an AR-15.

The affixable magazine of the invention satisfies the new firearms laws, being loadable in a way that does not violate the law.

The affixable magazine of the invention is a plastic or metal magazine for centerfire rifles which can be fixed into position so as to become a non-removable magazine, yet it can open while attached to the rifle for easy loading of cartridges.

The method of attachment of the affixable magazine will vary in accordance with the different makes and models of each rifle. The end result of the fixing of the magazine will be compliance with state or local laws, while also facilitating loading of the magazine in a convenient manner.

The affixable magazine of the invention allows a user to easily load the fixed magazine with ammunition without removing the magazine from the firearm, disassembling the action, or using tools. (If this is not legal in your state, a fixed magazine will be provided that requires a tool to open it to load ammunition, but it will open in the same manner as a fixed magazine that does not require a tool.)

A general aspect of the invention is an affixable ammunition magazine for use with a firearm having an upper receiver and a lower receiver, the lower receiver having a magazine well for receiving the ammunition magazine. The ammunition magazine includes: a magazine body configured to contain a stack of cartridges, the magazine body having a feeding end configured to feed rounds of ammunition to the firearm, the magazine body including: a side door configured to open downward from a closed position to an open position so as to permit loading of the stack of cartridges into the magazine body, and a rear side having a finger-pull slot terminating as a bottom hook; a cartridge follower assembly including: a cartridge follower, at least one finger pull attached to the cartridge follower, the at least one finger pull extending through the finger-pull slot of the rear side, the at least one finger pull being movable when released from the bottom hook, and a cartridge follower spring configured to be compressed by the cartridge follower when the at least one finger pull is engaged with the bottom hook, and configured to expand when the at least one finger pull is disengaged from the bottom hook, thereby allowing the cartridge follower to urge the stack of cartridges towards the feeding end of the ammunition magazine; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

In some embodiments, the affixable ammunition magazine further includes: a hinge attached to both the side door and to the magazine body; a locking pin attached to the magazine body; and a latch attached to the side door, the latch being configured to engage the locking pin so as to secure the side door in the closed position, or to release the locking pin so as to release the side door into the open position.

In some embodiments, the cartridge follower includes a rotatable shaft configured to move along and within the finger-pull slot, the at least one finger pull being attached to the rotatable shaft.

In some embodiments, the cartridge follower assembly further includes: a cartridge follower top plate configured to push upward on the bottom of the stack of cartridges; a cartridge follower bottom plate configured to facilitate attachment of the cartridge follower spring to the cartridge follower assembly; a pivot extending from the bottom plate towards the top plate of the cartridge follower; and a pivot block mounted on the pivot so as to enable the pivot block, the rotatable shaft, and the at least one finger pull to pivot.

In some embodiments, the cartridge follower bottom plate includes at least one spring attachment tab configured to attach the cartridge follower spring to the cartridge follower bottom plate.

In some embodiments, the magazine body, the side door, the cartridge follower, the cartridge follower spring, and the at least one finger pull are each made from at least one of: metal, nylon, plastic, carbon fiber.

Another general aspect of the invention is an affixable ammunition magazine for use with a firearm having an upper receiver and a lower receiver, the lower receiver having a magazine well for receiving the ammunition magazine. This ammunition magazine includes: a magazine body configured to contain a stack of cartridges, the magazine body having a feeding end configured to feed rounds of ammunition to the firearm, the magazine body including: a rear door configured to open downward from a closed position to an open position so as to permit loading of the stack of cartridges into the magazine body, and a right side and a left side each having a finger-pull slot terminating as a bottom hook; a cartridge follower assembly including: a cartridge follower, two finger pulls attached to the cartridge follower, the two finger pulls extending through the finger-pull slots of the right and left sides, the two finger pulls being movable when released from the respective bottom hooks, and a cartridge follower spring configured to be compressed by the cartridge follower when an at least one finger pull is engaged with the bottom hook, and configured to expand when the at least one finger pull is disengaged from the bottom hook, thereby allowing the cartridge follower to urge the stack of cartridges towards the feeding end of the ammunition magazine; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

In some embodiments, the affixable ammunition magazine further including: a hinge attached to both the rear door and to the magazine body; a locking pin attached to the magazine body; and a latch attached to the rear door, the latch being configured to engage the locking pin so as to secure the rear door in the closed position, or to release the locking pin so as to release the rear door into the open position.

In some embodiments, the two finger pulls are each attached to a respective rotatable shaft configured to ride within respective finger-pull slots.

In some embodiments, the cartridge follower assembly further includes: a cartridge follower top plate configured to push upward on the bottom of the stack of cartridges; a cartridge follower bottom plate configured to facilitate attachment of the cartridge follower spring to the cartridge follower assembly; a pivot extending from the bottom plate towards the top plate of the cartridge follower; and a pivot block mounted on the pivot so as to enable the pivot block, the rotatable shafts, and the two finger pulls to pivot.

In some embodiments, the cartridge follower bottom plate includes at least one spring attachment tab configured to attach the cartridge follower spring to the cartridge follower bottom plate.

In some embodiments, the magazine body, the rear door, the cartridge follower, the cartridge follower spring, and the at least one finger pull are each made from at least one of: metal, nylon, plastic, carbon fiber.

Another general aspect of the invention is an affixable ammunition magazine for use with a firearm having an upper receiver and a lower receiver, the lower receiver having a magazine well for receiving the ammunition magazine, the ammunition magazine comprising: a magazine body configured to contain a stack of cartridges, the magazine body having a feeding end configured to feed rounds of ammunition to the firearm, the magazine body including: a front door configured to open downward from a closed position to an open position so as to permit loading of the stack of cartridges into the magazine body, and a right side and a left side each having a finger-pull slot terminating as a bottom hook; a cartridge follower assembly including: a cartridge follower, two finger pulls attached to the cartridge follower, the two finger pulls extending through the finger-pull slots of the right and left sides, the two finger pulls being movable when released from the respective bottom hooks, and a cartridge follower spring configured to be compressed by the cartridge follower when an at least one finger pull is engaged with the bottom hook, and configured to expand when the at least one finger pull is disengaged from the bottom hook, thereby allowing the cartridge follower to urge the stack of cartridges towards the feeding end of the ammunition magazine; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

In some embodiments, the affixable ammunition magazine further includes: a hinge attached to both the front door and to the magazine body; a locking pin attached to the magazine body; and a latch attached to the front door, the latch being configured to engage the locking pin so as to secure the front door in the closed position, or to release the locking pin so as to release the front door into the open position.

In some embodiments, the two finger pulls are each attached to a respective rotatable shaft configured to ride within respective finger-pull slots.

In some embodiments, the cartridge follower assembly further includes: a cartridge follower top plate configured to push upward on the bottom of the stack of cartridges; a cartridge follower bottom plate configured to facilitate attachment of the cartridge follower spring to the cartridge follower assembly; a pivot extending from the bottom plate towards the top plate of the cartridge follower; and a pivot block mounted on the pivot so as to enable the pivot block, the rotatable shafts, and the two finger pulls to pivot.

In some embodiments, the cartridge follower bottom plate includes at least one spring attachment tab configured to attach the cartridge follower spring to the cartridge follower bottom plate.

In some embodiments, the magazine body, the front door, the cartridge follower, the cartridge follower spring, and the at least one finger pull are each made from at least one of: metal, nylon, plastic, carbon fiber.

BRIEF DESCRIPTION OF THE DRAWINGS

The invention will be more fully understood from the following detailed description, in conjunction with the following figures, wherein.

DETAILED DESCRIPTION

Figure 1A:
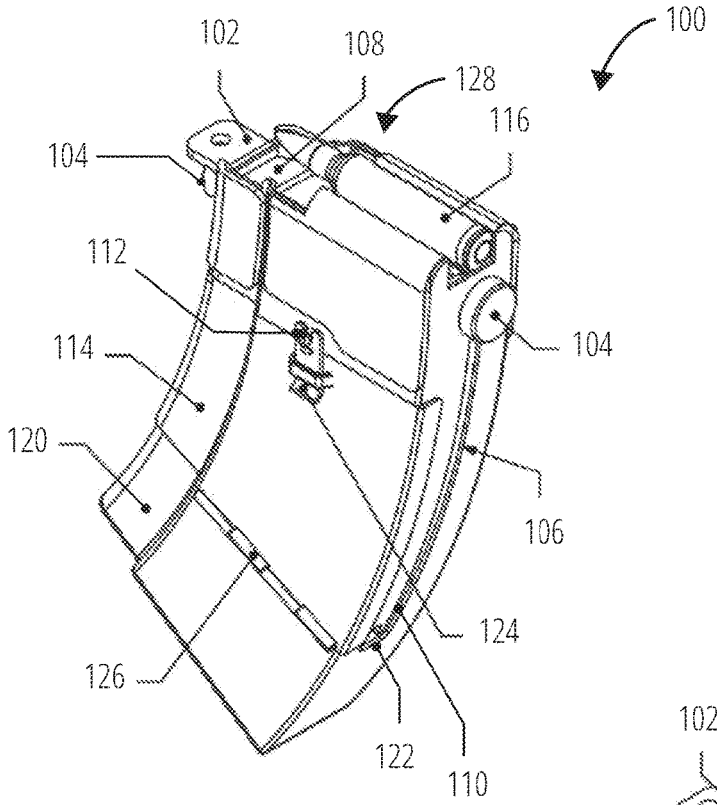
FIG. 1A is a perspective view showing the rear, side, and top views of an embodiment of an ammunition magazine that can be affixed to a firearm, while also facilitating loading of the ammunition magazine via a side door, with at least one finger pull in the upward position, also showing one cartridge within the ammunition magazine.

With reference to FIG. 1A, a perspective view is shown of an ammunition magazine 100 containing a single cartridge 116. The ammunition magazine 100 includes an attachable blocking tab 102 which is to be fixedly attached to a firearm lower receiver (not shown) such that the ammunition magazine 100 is prevented from being easily removed from the firearm. The attachable blocking tab 102, when attached to the lower receiver, blocks removal of the ammunition magazine 100 from the magazine well (not shown), the attachable blocking tab 102 being attached at a feeding end 128 after insertion of the ammunition magazine 100 into the magazine well (not shown), and before re-engaging the upper receiver (not shown) with the lower receiver (not shown).

Other embodiments of the ammunition magazine 100 may have alternative fixing methods to the attachable blocking tab 102, such as screws or other types of tabs, and all alternative fixing methods will attach the ammunition magazine 100 to the firearm lower receiver (not shown) in accordance with local laws.

In this embodiment, two finger pulls 104 are configured to be pulled down a finger-pull slot 106 toward a bottom hook 122 along both sides of the ammunition magazine 100 taking with it a cartridge follower 108 and compressing a cartridge follower spring 110, thereby opening a magazine cavity 118 (shown in FIG. 1B) configured to receive the stack of cartridges 116. A side door 114 is shown in a closed position, covering the magazine cavity 118 (shown in FIG. 1B). The side door 114 is hingedly attached to the magazine body 120 via a hinge 126. The ammunition magazine 100 includes a locking pin 112 fixedly attached to a magazine body 120. The locking pin 112 cooperates with a latch 124 configured to secure the side door 114 in the closed position, or the latch 124 can alternately be released from the locking pin 112 to release the side door 114 to an open position.

Figure 1B:
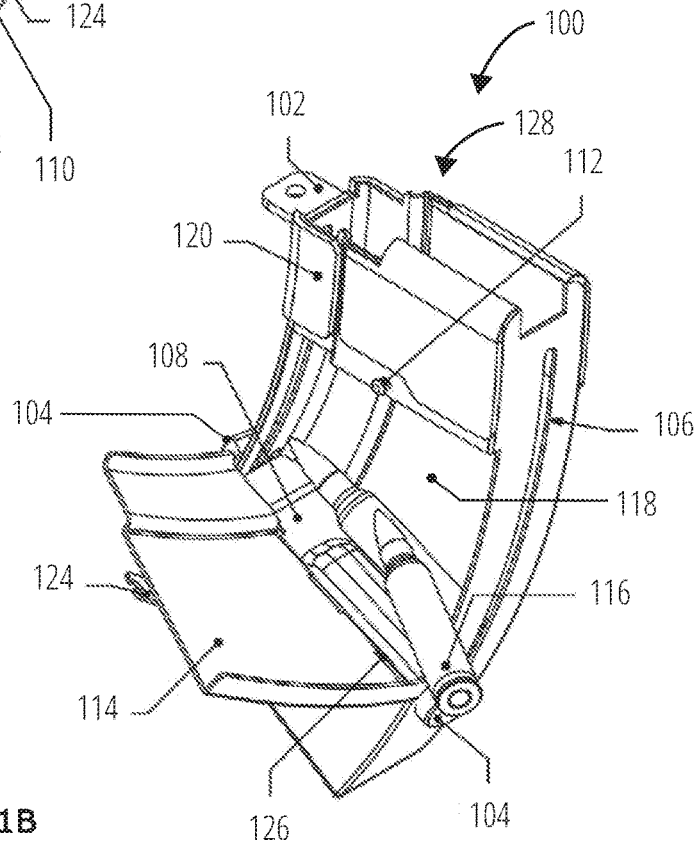
FIG. 1B is a perspective view of the magazine of FIG. 1A, showing the at least one finger pull in the down position, the side door in the open position, also showing a second cartridge being loaded into the ammunition magazine.

With reference to FIG. 1B, a perspective view is shown of the ammunition magazine 100 of FIG. 1A with two finger pulls 104 rotated and locked in place in a down position by engaging with a bottom hook 122 (shown in FIG. 1A) of a finger-pull slot 106, and a cartridge follower spring 110 in a compressed position. A side door 114 is hingedly attached to the magazine body 120 via a hinge 126. The ammunition magazine 100 includes a locking pin 112 fixedly attached to a magazine body 120. The locking pin 112 cooperates with a latch 124 configured to release the side door 114 to an open position, revealing a magazine cavity 118 sized to load a stack of cartridges 116 above a cartridge follower 108.

Figure 2A:
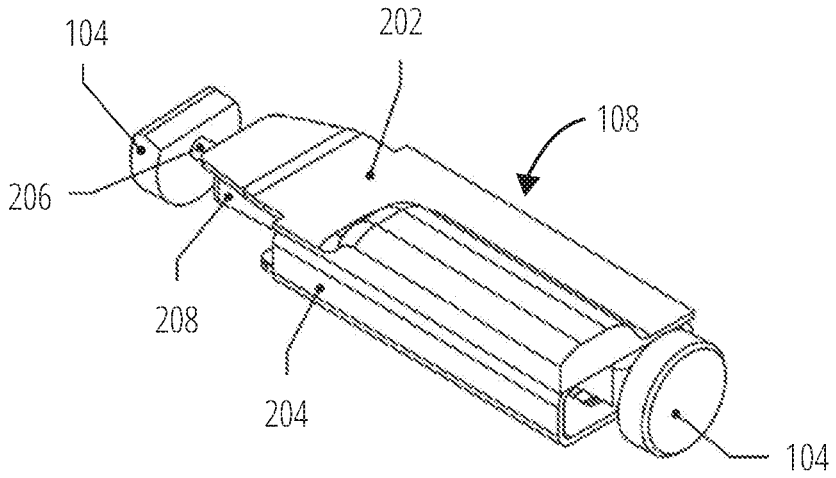
FIG. 2A is a perspective top view showing a cartridge follower having a U-shaped cartridge follower bottom plate and two finger pulls.

With reference to FIG. 2A, a perspective top view is shown of a cartridge follower 108 with a U-shaped cartridge follower bottom plate 204 and two finger pulls 104. A cartridge follower top plate 202 is attached to the U-shaped cartridge follower bottom plate 204.

A rotatable shaft 206 is attached to a pivot block 208. The pivot block 208 extends through the cartridge follower 108 between the cartridge follower top plate 202 and the U-shaped cartridge follower bottom plate 204. Once through the cartridge follower 108, the pivot block 208 terminates at another rotatable shaft 206. The two finger pulls 104 are attached to a respective rotatable shaft 206.

Figure 2B:
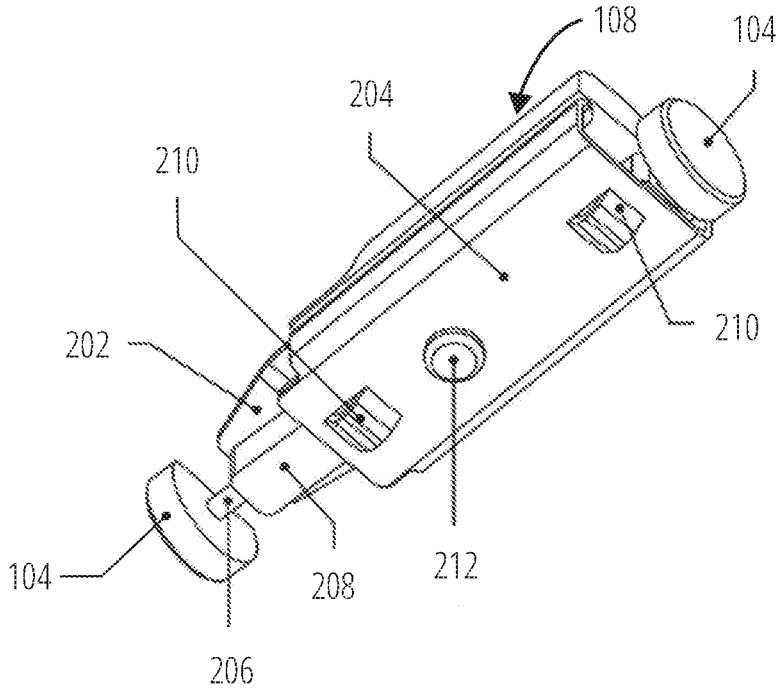
FIG. 2B is a perspective bottom view showing the cartridge follower of FIG. 2A having a U-shaped cartridge follower bottom plate and two finger pulls.

With reference to FIG. 2B, a perspective bottom view is shown of the cartridge follower 108 of FIG. 2A, having a U-shaped cartridge follower bottom plate 204 and two finger pulls 104.

A rotatable shaft 206 goes into a pivot block 208. A pivot 212 goes through the U-shaped cartridge follower bottom plate 204, through the pivot block 208 and attaches to a cartridge follower top plate 202. The pivot 212 is configured to allow the pivot block 208, the rotatable shaft 206, and the two finger pulls 104 to rotate about the pivot 212. The cartridge follower spring 110 (shown in FIG. 1A) is attached to the cartridge follower 108 by an at least one spring attachment tab 210 attached to the bottom of the U-shaped cartridge follower bottom plate 204.

Figure 3A:
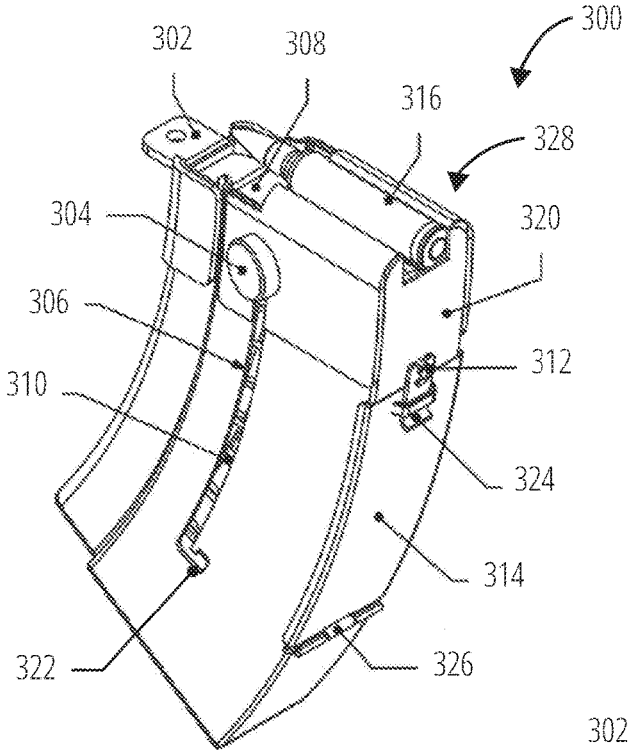
FIG. 3A is a perspective view showing the rear, side, and top views of an embodiment of an ammunition magazine that can be fixed to a firearm, while also facilitating loading of the ammunition magazine via a rear door, with at least one finger pull in the upward position, also showing one cartridge within the ammunition magazine.

With reference to FIG. 3A, a perspective view is shown of an ammunition magazine 300 containing a cartridge 316. The ammunition magazine 300 includes an attachable blocking tab 302 which is configured to be fixedly attached to a firearm lower receiver (not shown) such that the ammunition magazine 300 is prevented from being easily removed from the firearm. The attachable blocking tab 302, when attached to the lower receiver, blocks removal of the ammunition magazine 300 from the magazine well (not shown), the attachable blocking tab 302 being attached at a feeding end 328 after insertion of the ammunition magazine 300 into the magazine well (not shown), and before re-engaging the upper receiver (not shown) with the lower receiver (not shown).

Other embodiments of the ammunition magazine 300 may have alternative fixing methods to the attachable blocking tab 302, such as screws or other types of tabs, and all alternative fixing methods will attach the ammunition magazine 300 to the firearm lower receiver (not shown) in accordance with local laws.

In this embodiment, two finger pulls 304 are configured to be pulled down a finger-pull slot 306 toward a bottom hook 322 along both sides of the ammunition magazine 300 taking with it a cartridge follower 308 and compressing a cartridge follower spring 310, thereby opening a magazine cavity 318 (shown in FIG. 3B) configured to receive a stack of cartridges 316. A rear door 314 is shown in a closed position, covering the magazine cavity 318 (shown in FIG. 3B). The rear door 314 is hingedly attached to the magazine body 320 via a hinge 326. The ammunition magazine 300 includes a locking pin 312 fixedly attached to a magazine body 320. The locking pin 312 cooperates with a latch 324 configured to secure the rear door 314 in the closed position, or the latch 324 can alternately be released from the locking pin 312 to release the rear door 314 to an open position.

Figure 3B:
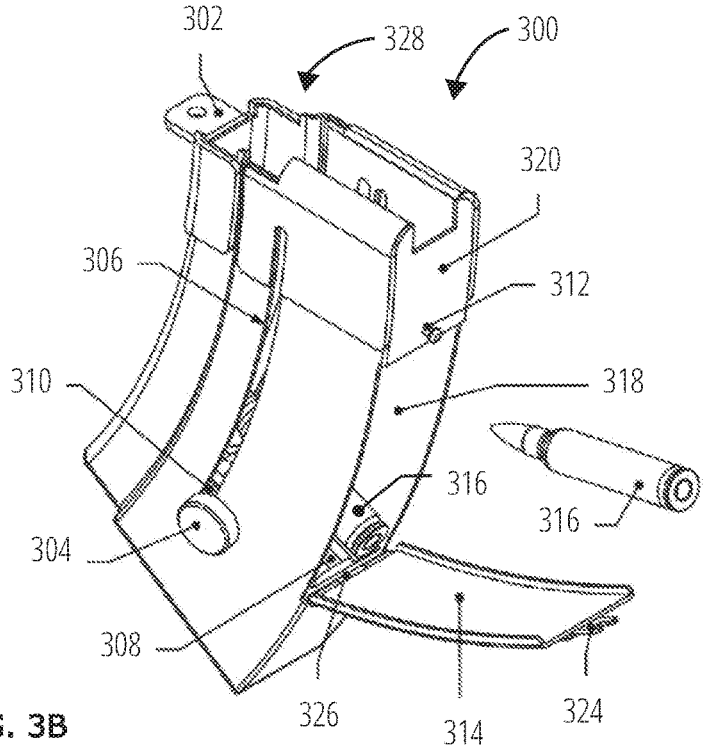
FIG. 3B is a perspective view of the magazine of FIG. 3A, showing the at least one finger pull in the down position, the rear door in the open position, showing one cartridge within the ammunition magazine, and also showing another cartridge being loaded into the ammunition magazine.

With reference to FIG. 3B, a perspective view is shown of the ammunition magazine 300 of FIG. 3A with two finger pulls 304 rotated and locked in place in a down position by engaging with a bottom hook 322 (shown in FIG. 3A) of a finger-pull slot 306, and a cartridge follower spring 310 in a compressed position. A rear door 314 is hingedly attached to the magazine body 320 via a hinge 326. The ammunition magazine 300 includes a locking pin 312 fixedly attached to a magazine body 320. The locking pin 312 cooperates with a latch 324 configured to release the rear door 314 to an open position, revealing a magazine cavity 318 and a space therein to load a stack of cartridges 316 above a cartridge follower 308.

Figure 4A:
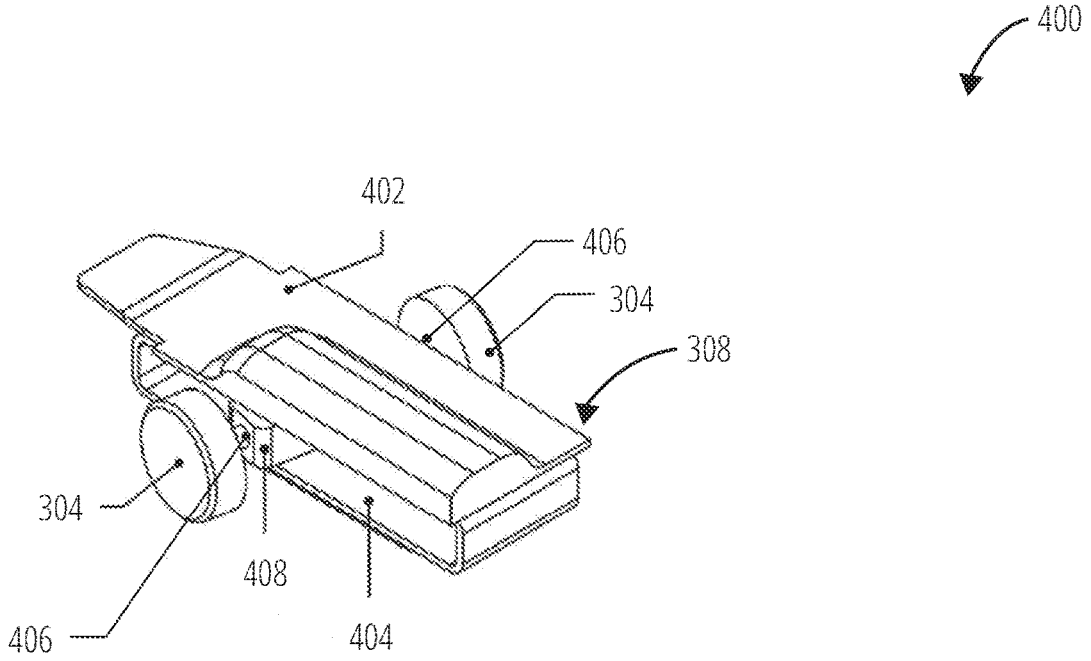
FIG. 4A is a perspective top view showing a cartridge follower having a U-shaped cartridge follower bottom plate and two finger pulls for the embodiment featuring a rear door.

With reference to FIG. 4A, a perspective top view is shown of a cartridge follower 308 with a U-shaped cartridge follower bottom plate 404 and two finger pulls 304. A cartridge follower top plate 402 is attached to a U-shaped cartridge follower bottom plate 404.

A rotatable shaft 406 is attached to a pivot block 408. The pivot block 408 extends through the cartridge follower 308 between the cartridge follower top plate 402 and the U-shaped cartridge follower bottom plate 404. On the other side of the cartridge follower 308, the pivot block 408 terminates at respective rotatable shafts 406. The two finger pulls 304 are each attached to respective rotatable shafts 406.

Figure 4B:
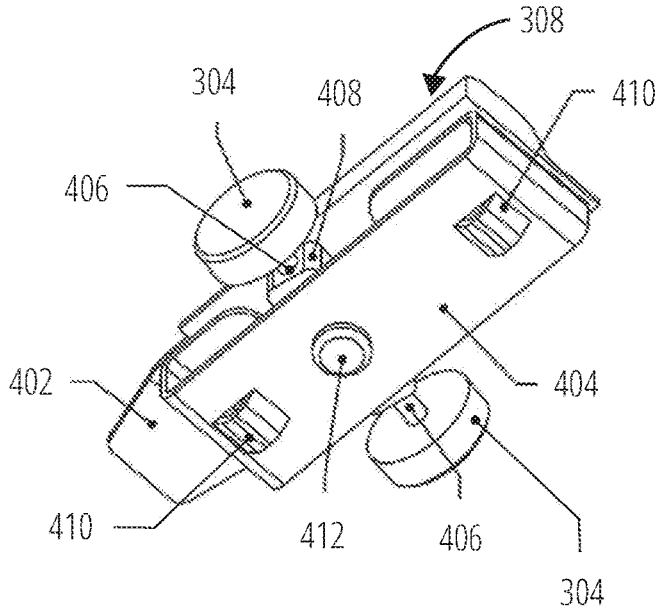
FIG. 4B is a perspective bottom view showing the cartridge follower of FIG. 4A having a U-shaped cartridge follower bottom plate and two finger pulls for the embodiment featuring a rear door.

With reference to FIG. 4B, a perspective bottom view is shown of a cartridge follower 308 with a U-shaped cartridge follower bottom plate 404 and two finger pulls 304.

A rotatable shaft 406 goes into a pivot block 408. A pivot 412 goes through the U-shaped cartridge follower bottom plate 404, through the pivot block 408 and attaches to a cartridge follower top plate 402. The pivot 412 is configured to allow the pivot block 408, the rotatable shafts 406, and each of the two finger pulls 304 to rotate about the pivot 412. The cartridge follower spring 310 (shown in FIG. 3A) is attached to the cartridge follower 308 by an at least one spring attachment tab 410 attached to the bottom of the U-shaped cartridge follower bottom plate 404.

Figure 5A:
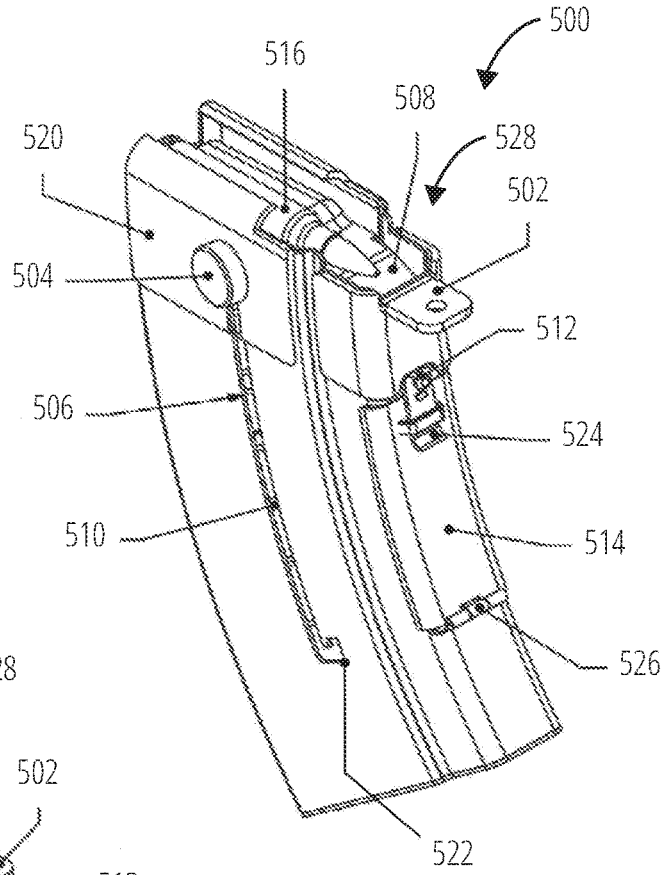
FIG. 5A is a perspective view showing the rear, side, and top views of an embodiment of an ammunition magazine that can be fixed to a firearm, while also facilitating loading of the ammunition magazine via a front door, with at least one finger pull in the upward position, also showing one cartridge within the ammunition magazine.

With reference to FIG. 5A, a perspective view is shown of an ammunition magazine 500 containing a cartridge 516. The ammunition magazine 500 includes an attachable blocking tab 502 which is to be fixedly attached to a firearm lower receiver (not shown) such that the ammunition magazine 500 is prevented from being easily removed from the firearm. The ammunition magazine 500 includes an attachable blocking tab 502 which can be fixedly attached to a firearm lower receiver (not shown) such that the ammunition magazine 500 is not easily removed from the firearm. The attachable blocking tab 502, when attached to the lower receiver, blocks removal of the ammunition magazine 500 from the magazine well (not shown), the attachable blocking tab 502 being attached at a feeding end 528 after insertion of the ammunition magazine 500 into the magazine well (not shown), and before re-engaging the upper receiver (not shown) with the lower receiver (not shown).

Other embodiments of the ammunition magazine 500 may have alternative fixing methods to the attachable blocking tab 502, such as screws or other types of tabs, and all alternative fixing methods will attach the ammunition magazine 500 to the firearm lower receiver (not shown) in accordance with local laws.

In this embodiment, two finger pulls 504 are configured to be pulled down a finger-pull slot 506 toward a bottom hook 522 along both sides of the ammunition magazine 500 taking with it a cartridge follower 508 and compressing a cartridge follower spring 510, thereby opening a magazine cavity 518 (shown in FIG. 5B) configured to receive the stack of cartridges 516. A front door 514 is shown in a closed position, covering the magazine cavity 518 (shown in FIG. 5B). The front door 514 is hingedly attached to the magazine body 520 via a hinge 526. The ammunition magazine 500 includes a locking pin 512 fixedly attached to a magazine body 520. The locking pin 512 cooperates with a latch 524 configured to secure the front door 514 in the closed position, or the latch 524 can alternately be released from the locking pin 512 to release the front door 514 to an open position.

Figure 5B:
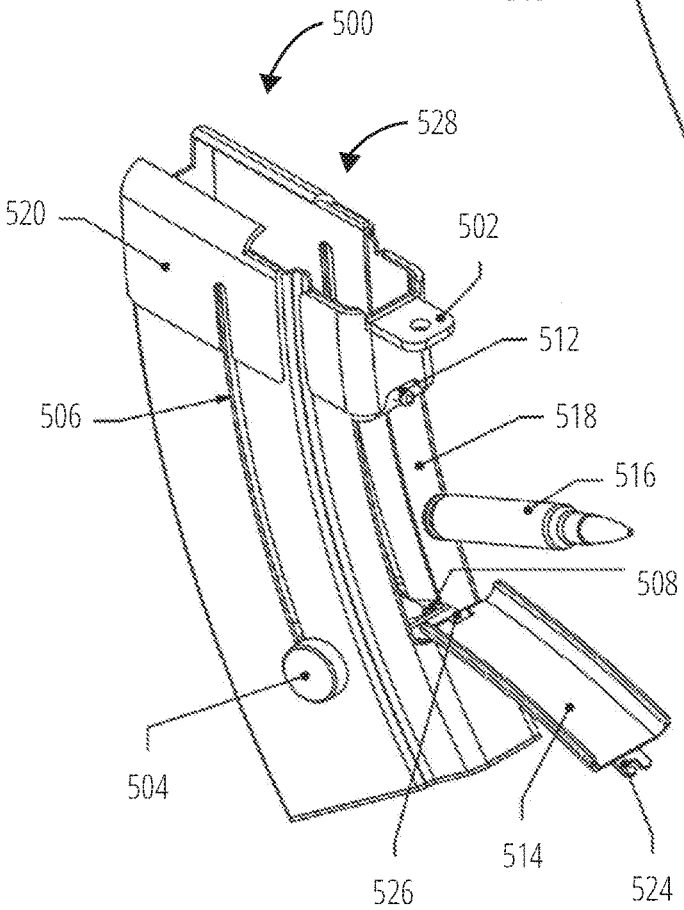
FIG. 5B is a perspective view of the magazine of FIG. 5A, showing the at least one finger pull in the down position, the front door in the open position, showing one cartridge within the ammunition magazine, and also showing another cartridge being loaded into the ammunition magazine.

With reference to FIG. 5B, a perspective view is shown of the ammunition magazine 500 of FIG. 5A with two finger pulls 504 rotated and locked in place in a down position by engaging with a bottom hook 522 (shown in FIG. 5A) of a finger-pull slot 506, and a cartridge follower spring 510 in a compressed position. A front door 514 is hingedly attached to the magazine body 520 via a hinge 526. The ammunition magazine 500 includes a locking pin 512 fixedly attached to a magazine body 520. The locking pin 512 cooperates with a latch 524 configured to release the front door 514 to an open position, revealing a magazine cavity 518 and a space therein sized to load a stack of cartridges 516 above a cartridge follower 508.

Figure 6A:
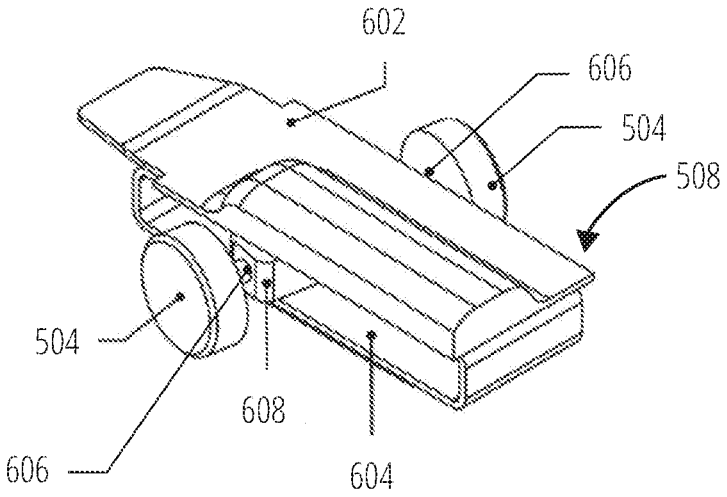
FIG. 6A is a perspective top view showing a cartridge follower having a U-shaped cartridge follower bottom plate and two finger pulls for the embodiment featuring a front door.

With reference to FIG. 6A, a perspective top view is shown of a cartridge follower 508 with a U-shaped cartridge follower bottom plate 604 and two finger pulls 504. A cartridge follower top plate 602 is attached to a U-shaped cartridge follower bottom plate 604.

A rotatable shaft 606 is attached to a pivot block 608. The pivot block 608 extends through the cartridge follower 508 between the cartridge follower top plate 602 and the U-shaped cartridge follower bottom plate 604. On the other side of the cartridge follower 508, the pivot block 608 terminates at the rotatable shaft 606. The two finger pulls 504 are attached to respective rotatable shafts 606.

Figure 6B:
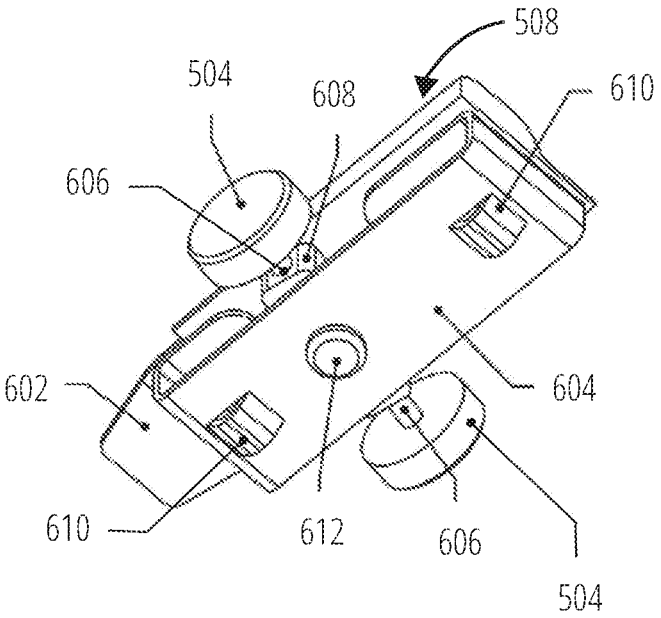
FIG. 6B is a perspective bottom view showing the cartridge follower of FIG. 6A having a U-shaped cartridge follower bottom plate and two finger pulls for the embodiment featuring a front door.

With reference to FIG. 6B, a perspective bottom view is shown of a cartridge follower 508 with a U-shaped cartridge follower bottom plate 604 and two finger pulls 504.

A rotatable shaft 606 goes into a pivot block 608. A pivot 612 goes through the U-shaped cartridge follower bottom plate 604, through the pivot block 608 and attaches to a cartridge follower top plate 602. The pivot 612 is configured to allow the pivot block 608, rotatable shafts 606, and each of the two finger pulls 504 to rotate about the pivot 612. The cartridge follower spring 510 (shown in FIG. 5A) is attached to the cartridge follower 508 by an at least one spring attachment tab 610 attached to the bottom of the U-shaped cartridge follower bottom plate 604.

Installing the Fixed Magazine

To install the affixable magazine of the invention (e.g., any of the embodiments disclosed herein) on the firearm, the upper receiver is first separated from the lower receiver. Once the top of the lower receiver is exposed, the affixable magazine of the invention is inserted up into the magazine well.

In some embodiments of the invention, a blocking tab is then placed over the top of the affixable magazine such that the blocking tab overlaps a portion of the upper side of the lower receiver. The blocking tab is then attached to the affixable magazine using a screw which fixes the tab to both the lower receiver and the fixed magazine, so that the now fixed magazine cannot be removed from the firearm without separating the upper receiver and the lower receiver.

Loading the Magazine

Because the magazine is fixed to the firearm while the upper receiver and the lower receiver of the firearm are engaged, the magazine cannot be loaded from the top of the fixed magazine. Instead, a side-loading method is used. A hinged door located on the magazine is opened to allow the magazine to be loaded with cartridges. In addition, when loading the magazine, one uses at least one finger-pull located in a slot on at least one side of the magazine to retract the spring-loaded cartridge follower.

During the loading process, the at least one finger-pull is pulled down along the at least one slot in the magazine. The at least one finger-pull is locked in the down position by moving the finger-pull into a bottom hook, located at the bottom of the finger-pull slot. When the finger-pull is in the down and hooked position, the magazine spring is compressed, and the cartridge follower is locked in the down position.

The magazine is then opened by opening the hinged door, which reveals a cavity within the magazine body which provides space for loading a stack of ammunition cartridges. Once the magazine body is opened, the user can easily load ammunition cartridges into the magazine body.

Once the stack of cartridges is loaded, the hinged door is closed, and the at least one finger-pull is unhooked from the respective bottom hook. Once the finger-pull(s) is(are) released from the bottom hook(s), the cartridge follower pushes up against the stack of cartridges, allowing the magazine and the firearm to work normally.

Other modifications and implementations will occur to those skilled in the art without departing from the spirit and the scope of the invention as claimed. Accordingly, the above description is not intended to limit the invention, except as indicated in the following claims.

What is claimed is:

1. An affixable ammunition magazine configured for use with a firearm having an upper receiver and a lower receiver, the receivers configured to be disengaged and re-engaged, the lower receiver having a magazine well for receiving the ammunition magazine, the ammunition magazine comprising:

a magazine body configured to contain a stack of cartridges, the magazine body having a feeding end configured to feed rounds of ammunition to the firearm, the magazine body including:

a side door configured to open downward from a closed position to an open position so as to permit loading of the stack of cartridges into the magazine body, and a rear side having a finger-pull slot terminating as a bottom hook;

a cartridge follower assembly including:

a cartridge follower, at least one finger pull attached to the cartridge follower, the at least one finger pull extending through the finger-pull slot of the rear side, the at least one finger pull being movable when released from the bottom hook, and a cartridge follower spring configured to be compressed by the cartridge follower when the at least one finger pull is engaged with the bottom hook, and configured to expand when the at least one finger pull is disengaged from the bottom hook, thereby allowing the cartridge follower to urge the stack of cartridges towards the feeding end of the magazine body; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

2. The affixable ammunition magazine of claim 1, further comprising:

a hinge attached to both the side door and to the magazine body;

a locking pin attached to the magazine body; and a latch attached to the side door, the latch being configured to engage the locking pin so as to secure the side door in the closed position, or to release the locking pin so as to release the side door into the open position.

3. The affixable ammunition magazine of claim 1, wherein the cartridge follower includes a rotatable shaft configured to move along and within the finger-pull slot, the at least one finger pull being attached to the rotatable shaft.

4. The affixable ammunition magazine of claim 3, wherein the cartridge follower assembly further includes:

a cartridge follower top plate configured to push upward on the bottom of the stack of cartridges;

a cartridge follower bottom plate configured to facilitate attachment of the cartridge follower spring to the cartridge follower assembly;

a pivot extending from the bottom plate towards the top plate of the cartridge follower; and a pivot block mounted on the pivot so as to enable the pivot block, the rotatable shaft, and the at least one finger pull to pivot.

5. The affixable ammunition magazine of claim 4, wherein the cartridge follower bottom plate includes at least one spring attachment tab configured to attach the cartridge follower spring to the cartridge follower bottom plate.

6. The affixable ammunition magazine of claim 1, wherein the magazine body, the side door, the cartridge follower, the cartridge follower spring, and the at least one finger pull are each made from at least one of: metal, nylon, plastic, carbon fiber.

7. An affixable ammunition magazine configured for use with a firearm having an upper receiver and a lower receiver, the receivers configured to be disengaged and re-engaged, the lower receiver having a magazine well for receiving the ammunition magazine, the ammunition magazine comprising:

a magazine body configured to contain a stack of cartridges, the magazine body having a feeding end configured to feed rounds of ammunition to the firearm, the magazine body including:

a rear door configured to open downward from a closed position to an open position so as to permit loading of the stack of cartridges into the magazine body, and a right side and a left side each having a finger-pull slot terminating as a bottom hook;

a cartridge follower assembly including:

a cartridge follower, two finger pulls attached to the cartridge follower, the two finger pulls extending through the finger-pull slots of the right and left sides, the two finger pulls being movable when released from the respective bottom hooks, and a cartridge follower spring configured to be compressed by the cartridge follower when an at least one finger pull is engaged with the bottom hook, and configured to expand when the at least one finger pull is disengaged from the bottom hook, thereby allowing the cartridge follower to urge the stack of cartridges towards the feeding end of the magazine body; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

8. The affixable ammunition magazine of claim 7, further comprising:

a hinge attached to both the rear door and to the magazine body;

a locking pin attached to the magazine body; and a latch attached to the rear door, the latch being configured to engage the locking pin so as to secure the rear door in the closed position, or to release the locking pin so as to release the rear door into the open position.

9. The affixable ammunition magazine of claim 7, wherein the two finger pulls are each attached to a respective rotatable shaft configured to ride within respective finger-pull slots.

10. The affixable ammunition magazine of claim 9, wherein the cartridge follower assembly further includes:

a cartridge follower top plate configured to push upward on the bottom of the stack of cartridges;

a cartridge follower bottom plate configured to facilitate attachment of the cartridge follower spring to the cartridge follower assembly;

a pivot extending from the bottom plate towards the top plate of the cartridge follower; and a pivot block mounted on the pivot so as to enable the pivot block, the rotatable shafts, and the two finger pulls to pivot.

11. The affixable ammunition magazine of claim 10, wherein the cartridge follower bottom plate includes at least one spring attachment tab configured to attach the cartridge follower spring to the cartridge follower bottom plate.

12. The affixable ammunition magazine of claim 7, wherein the magazine body, the rear door, the cartridge follower, the cartridge follower spring, and the at least one finger pull are each made from at least one of: metal, nylon, plastic, carbon fiber.

13. An affixable ammunition magazine configured for use with a firearm having an upper receiver and a lower receiver, the receivers configured to be disengaged and re-engaged, the lower receiver having a magazine well for receiving the ammunition magazine, the ammunition magazine comprising:

a magazine body configured to contain a stack of cartridges, the magazine body having a feeding end configured to feed rounds of ammunition to the firearm, the magazine body including:

a front door configured to open downward from a closed position to an open position so as to permit loading of the stack of cartridges into the magazine body, and a right side and a left side each having a finger-pull slot terminating as a bottom hook;

a cartridge follower assembly including:

a cartridge follower, two finger pulls attached to the cartridge follower, the two finger pulls extending through the finger-pull slots of the right and left sides, the two finger pulls being movable when released from the respective bottom hooks, and a cartridge follower spring configured to be compressed by the cartridge follower when an at least one finger pull is engaged with the bottom hook, and configured to expand when the at least one finger pull is disengaged from the bottom hook, thereby allowing the cartridge follower to urge the stack of cartridges towards the feeding end of the magazine body; and an attachable blocking tab configured to be attached to the feeding end of the magazine body, and configured to block removal of the ammunition magazine from the magazine well, the attachable blocking tab being attached to the feeding end of the magazine body after insertion of the ammunition magazine into the magazine well, and before re-engaging the upper receiver with the lower receiver.

14. The affixable ammunition magazine of claim 13, further comprising:

a hinge attached to both the front door and to the magazine body;

a locking pin attached to the magazine body; and a latch attached to the front door, the latch being configured to engage the locking pin so as to secure the front door in the closed position, or to release the locking pin so as to release the front door into the open position.

15. The affixable ammunition magazine of claim 13, wherein the two finger pulls are each attached to a respective rotatable shaft configured to ride within respective finger-pull slots.

16. The affixable ammunition magazine of claim 15, wherein the cartridge follower assembly further includes:

a cartridge follower top plate configured to push upward on the bottom of the stack of cartridges;

a cartridge follower bottom plate configured to facilitate attachment of the cartridge follower spring to the cartridge follower assembly;

a pivot extending from the bottom plate towards the top plate of the cartridge follower; and a pivot block mounted on the pivot so as to enable the pivot block, the rotatable shafts, and the two finger pulls to pivot.

17. The affixable ammunition magazine of claim 16, wherein the cartridge follower bottom plate includes at least one spring attachment tab configured to attach the cartridge follower spring to the cartridge follower bottom plate.

18. The affixable ammunition magazine of claim 13, wherein the magazine body, the front door, the cartridge follower, the cartridge follower spring, and the at least one finger pull are each made from at least one of: metal, nylon, plastic, carbon fiber.

* * * * *